US008041273B2

(12) United States Patent
Okabe

(10) Patent No.: US 8,041,273 B2
(45) Date of Patent: Oct. 18, 2011

(54) PHOTOSENSITIVE DRUM UNIT AND IMAGE FORMING APPARATUS CAPABLE OF SUPPRESSING REGISTRATION ERROR

(75) Inventor: Yasushi Okabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 646 days.

(21) Appl. No.: 11/972,236

(22) Filed: Jan. 10, 2008

(65) Prior Publication Data

US 2008/0181663 A1 Jul. 31, 2008

(30) Foreign Application Priority Data

Jan. 30, 2007 (JP) ..... 2007-019880

(51) Int. Cl.
*G03G 15/01* (2006.01)

(52) U.S. Cl. ..... 399/301; 399/107; 399/110; 399/112; 399/299

(58) Field of Classification Search ..... 399/107, 399/110, 116, 117, 297–301
See application file for complete search history.

(56) References Cited

U.S. PATENT DOCUMENTS

| | | | | |
|---|---|---|---|---|
| 4,796,050 | A * | 1/1989 | Furuta et al. | 399/167 |
| 6,360,070 | B1 * | 3/2002 | Taka et al. | 399/301 |
| 6,930,786 | B2 * | 8/2005 | Kataoka et al. | 358/1.12 |
| 2005/0009351 | A1 * | 1/2005 | Takahashi et al. | 438/689 |
| 2005/0286937 | A1 * | 12/2005 | Kim et al. | 399/299 |

FOREIGN PATENT DOCUMENTS

| | | |
|---|---|---|
| JP | 2001-188395 | 7/2001 |
| JP | 2005-010466 | 1/2005 |

* cited by examiner

*Primary Examiner* — David Porta
*Assistant Examiner* — Jessica L Eley
(74) *Attorney, Agent, or Firm* — Banner & Witcoff, Ltd.

(57) ABSTRACT

A photosensitive drum unit includes a frame and a plurality of photosensitive drums. The plurality of photosensitive drums is supported by the frame and has a shape identical with one another. Each of the plurality of photosensitive drums is rotatable about a rotational axis. The plurality of photosensitive drums is arranged such that a distance between rotational axes of adjacent photosensitive drums is a constant distance P. Each of the plurality of photosensitive drums has a circumferential reference position that is common to all of the plurality of photosensitive drums. Each of the plurality of photosensitive drums has a plurality of marks at circumferential positions that are defined relative to the circumferential reference position. Adjacent two positions of the circumferential positions are spaced by a central angle of $\{(S-P)/S\}\times 360°$ where S is a circumferential length of each of the plurality of photosensitive drums.

14 Claims, 10 Drawing Sheets

PHOTOSENSITIVE DRUM UNIT AND IMAGE FORMING APPARATUS CAPABLE OF SUPPRESSING REGISTRATION ERROR

CROSS REFERENCE TO RELATED APPLICATIONS

This application claims priority from Japanese Patent Application No. 2007-019880 filed Jan. 30, 2007. The entire content of the priority application is incorporated herein by reference.

TECHNICAL FIELD

The invention relates to a photosensitive drum unit, and an image forming apparatus provided with the photosensitive drum unit.

BACKGROUND

A tandem-type image forming apparatus is well known in the art. One such tandem-type image forming apparatus has photosensitive drums corresponding to each of the colors yellow, magenta, cyan, and black that are juxtaposed in a horizontal direction. In this tandem-type image forming apparatus, toner images in each color are formed almost simultaneously on the respective photosensitive drums and are then sequentially transferred from the photosensitive drums to a sheet of paper conveyed sequentially past each photosensitive drum so that the images are superimposed on one another, thereby achieving color image formation at substantially the same speed as single-color image formation with a monochromatic image forming apparatus.

However, this tandem-type color image forming apparatus can have problems with color registration when the color toner images are not properly aligned. For example, if a photosensitive drum has eccentricity, the distance between a scanning unit and the exposed surface of the photosensitive drum varies depending on the rotated position of the photosensitive drum, producing error in the laser scanning width on the photosensitive drum. When such error varies for each photosensitive drum, the toner images in each color cannot be properly aligned on the paper, resulting in color registration error.

Technologies, such as that disclosed in Japanese Patent Application Publication No. 2001-188395, have been proposed for reducing color registration error by canceling the effects of variations in the distance between the scanning unit and the exposure surface of the photosensitive drum caused by eccentricity of the drum. This is achieved by detecting the eccentric phase of each photosensitive drum and adjusting the speed of the motor driving each photosensitive drum to match the exposure start timing (write out timing of the electrostatic latent image) for each photosensitive drum so that the eccentric phase of each photosensitive drum is aligned relative to the image.

However, the conventional method described above requires such components as sensors for detecting the eccentric phase of the photosensitive drums and circuits for processing the detection signals outputted by the sensors, thereby increasing the complexity of the structure of the image forming apparatus as well as manufacturing costs.

SUMMARY

In view of the foregoing, it is an object of the invention to provide a photosensitive drum unit and an image forming apparatus capable of aligning the eccentric phases of the photosensitive drums relative to an image through a simple and inexpensive construction.

In order to attain the above and other objects, the invention provides a photosensitive drum unit. The photosensitive drum unit includes a frame and a plurality of photosensitive drums. The plurality of photosensitive drums is supported by the frame and has a shape identical with one another. Each of the plurality of photosensitive drums is rotatable about a rotational axis. The plurality of photosensitive drums is arranged such that a distance between rotational axes of adjacent photosensitive drums is a constant distance P. Each of the plurality of photosensitive drums has a circumferential reference position that is common to all of the plurality of photosensitive drums. Each of the plurality of photosensitive drums has a plurality of marks at circumferential positions that are defined relative to the circumferential reference position. Adjacent two positions of the circumferential positions are spaced by a central angle of $\{(S-P)/S\}\times 360°$ where S is a circumferential length of each of the plurality of photosensitive drums.

According to another aspect, the invention also provides an image forming apparatus. The image forming apparatus includes an apparatus main body and a photosensitive drum unit mounted on the apparatus main body. The photosensitive drum unit includes a frame and a plurality of photosensitive drums. The plurality of photosensitive drums is supported by the frame and has a shape identical with one another. Each of the plurality of photosensitive drums is rotatable about a rotational axis. The plurality of photosensitive drums is arranged such that a distance between rotational axes of adjacent photosensitive drums is a constant distance P. Each of the plurality of photosensitive drums has a circumferential reference position that is common to all of the plurality of photosensitive drums. Each of the plurality of photosensitive drums has a plurality of marks at circumferential positions that are defined relative to the circumferential reference position. Adjacent two positions of the circumferential positions are spaced by a central angle of $\{(S-P)/S\}\times 360°$ where S is a circumferential length of each of the plurality of photosensitive drums.

BRIEF DESCRIPTION OF THE DRAWINGS

Embodiments in accordance with the invention will be described in detail with reference to the following figures wherein.

DETAILED DESCRIPTION

A photosensitive drum unit and an image forming apparatus according to an embodiment of the invention will be described while referring to FIGS. 1 through 8D. The image forming apparatus of the embodiment is applied to a color laser printer.

Figure 1:
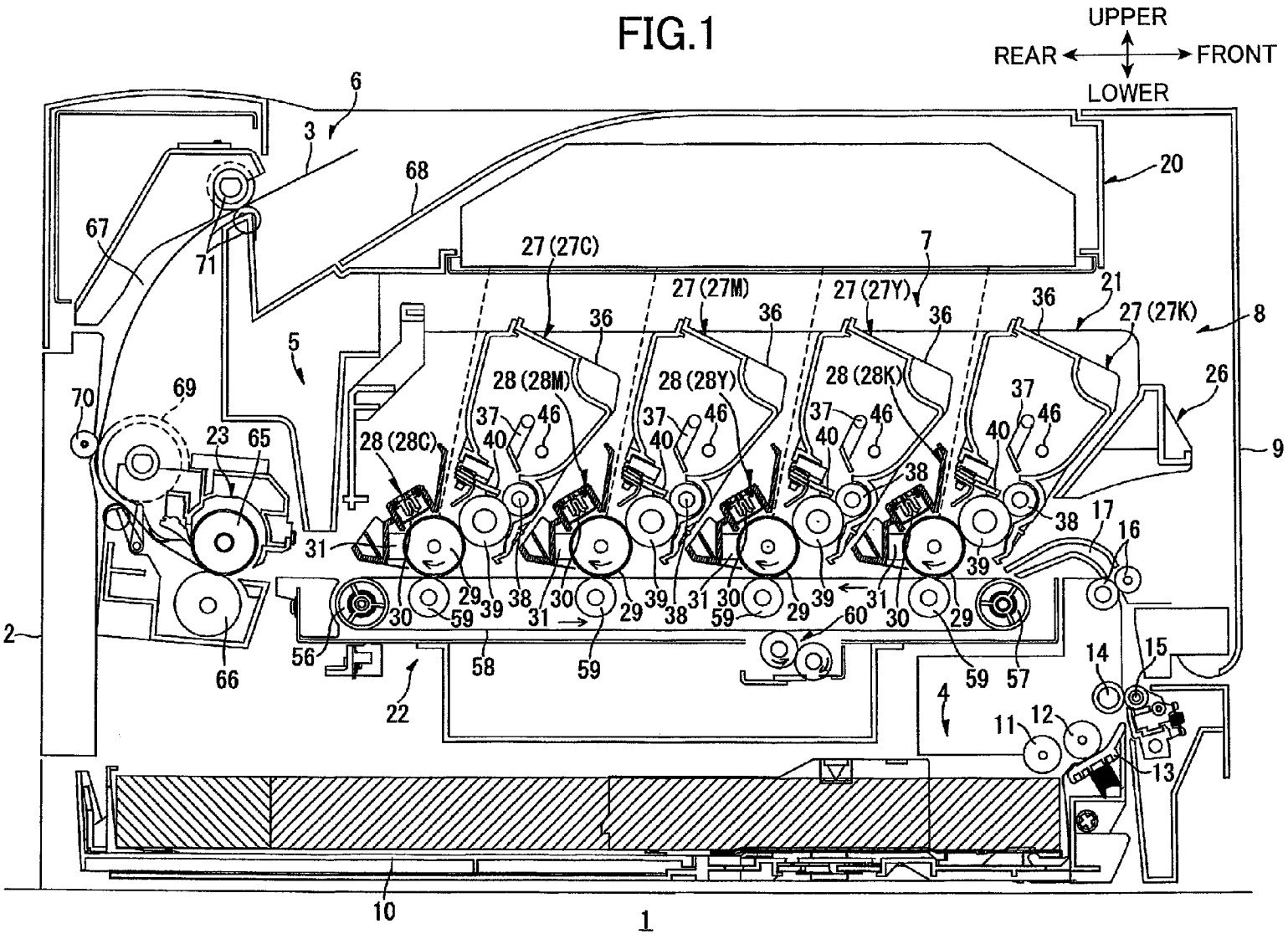
FIG. 1 is a vertical cross-sectional view showing the structure of a color laser printer embodying an image forming apparatus according to an embodiment of the invention.

As shown in FIG. 1, a color laser printer 1 is a transversal tandem color laser printer including a plurality of photosensitive drums 29 described later arranged in the horizontal direction.

The color laser printer 1 includes a main casing 2 and, within the main casing 2, a feeding unit 4 for feeding sheets of paper 3, an image-forming unit 5 for forming images on the fed paper 3, and a discharge unit 6 for discharging the paper 3 formed with the images.

(1) Main Casing

The main casing 2 is shaped like a substantially rectangular box in a side view. A drum accommodating space 7 is formed inside the main casing 2 for accommodating a drum unit 26 described later.

A front wall of the main casing 2 is formed with an access opening 8 in communication with the drum accommodating space 7, and is provided with a front cover 9 capable of opening and closing over the access opening 8. The front cover 9 is supported so as to be movable between an opened state where the front cover 9 inclines forward to open the access opening 8 and a closed state where the front cover 9 stands along the front surface of the main casing 2 to close the access opening 8. When the front cover 9 is open, the access opening 8 is exposed, enabling the drum unit 26 to be mounted into or removed from the drum accommodating space 7 in the main casing 2 via the access opening 8.

Note that in the following description, the expressions "front", "rear", "left", "right", "above", and "below" are used to define the various parts when the color laser printer 1 is disposed in an orientation in which it is intended to be used. More specifically, a side of the color laser printer 1 on which the front cover 9 is provided is referred to "front" side, while a side opposite the front side is referred to "rear" side. Further, "left" and "right" sides are used to define the left and right sides of the color laser printer 1 when the color laser printer 1 is viewed from the front side. Regarding the drum unit 26, the expressions "front", "rear", "left", "right", "above", and "below" are used to define parts of the drum unit 26 when the drum unit 26 is mounted on the main casing 2.

(2) Feeding Unit

The feeding unit 4 includes a paper tray 10 that is detachably mounted in the bottom section of the main casing 2; a pickup roller 11 disposed above the front end of the paper tray 10; a substantially U-shaped feeding path 17 leading from a position above the front end of the paper tray 10 to a conveying belt 58 described later; and a separating roller 12, a separating pad 13, a pinch roller 14, a paper dust roller 15, and a pair of registration rollers 16 disposed along the feeding path 17.

By rotating, the pickup roller 11 conveys sheets of the paper 3 stacked in the paper tray 10 along the feeding path 17. The separating roller 12 and separating pad 13 separate the conveyed sheets of paper 3 so that only one sheet is fed onto the feeding path 17 at a time. The paper dust roller 15 removes dust from the paper 3 as the paper 3 passes between the pinch roller 14 and paper dust roller 15 while being conveyed to the registration rollers 16. The registration rollers 16 register the paper 3 and subsequently convey the paper 3 onto the conveying belt 58.

(3) Image-Forming Unit

The image-forming unit 5 includes a scanning unit 20, a process unit 21, a transfer unit 22, and a fixing unit 23.

(3-1) Scanning Unit

The scanning unit 20 is disposed in the top section of the main casing 2. The scanning unit 20 includes lasers, mirrors, lenses, and other optical components, by which the scanning unit 20 emits four laser beams toward the four photosensitive drums 29 described later. As indicated by the dotted lines in FIG. 1, the laser beams are irradiated onto the surfaces of the photosensitive drums 29 in a high-speed scan.

(3-2) Process Unit

The process unit 21 is disposed in the main casing 2 below the scanning unit 20 and above the feeding unit 4. The process unit 21 includes the single drum unit 26, and four developer cartridges 27 corresponding to the colors black, yellow, magenta, and cyan (specifically, developer cartridges 27K, 27Y, 27M, and 27C).

(3-2-1) Drum Unit

The tandem-type drum unit 26 is accessed through the access opening 8 and can be moved in or out of the main casing 2 via the access opening 8 by sliding the drum unit 26 horizontally. The drum unit 26 is provided with four drum subunits 28 corresponding to each of the above colors.

Figure 2:
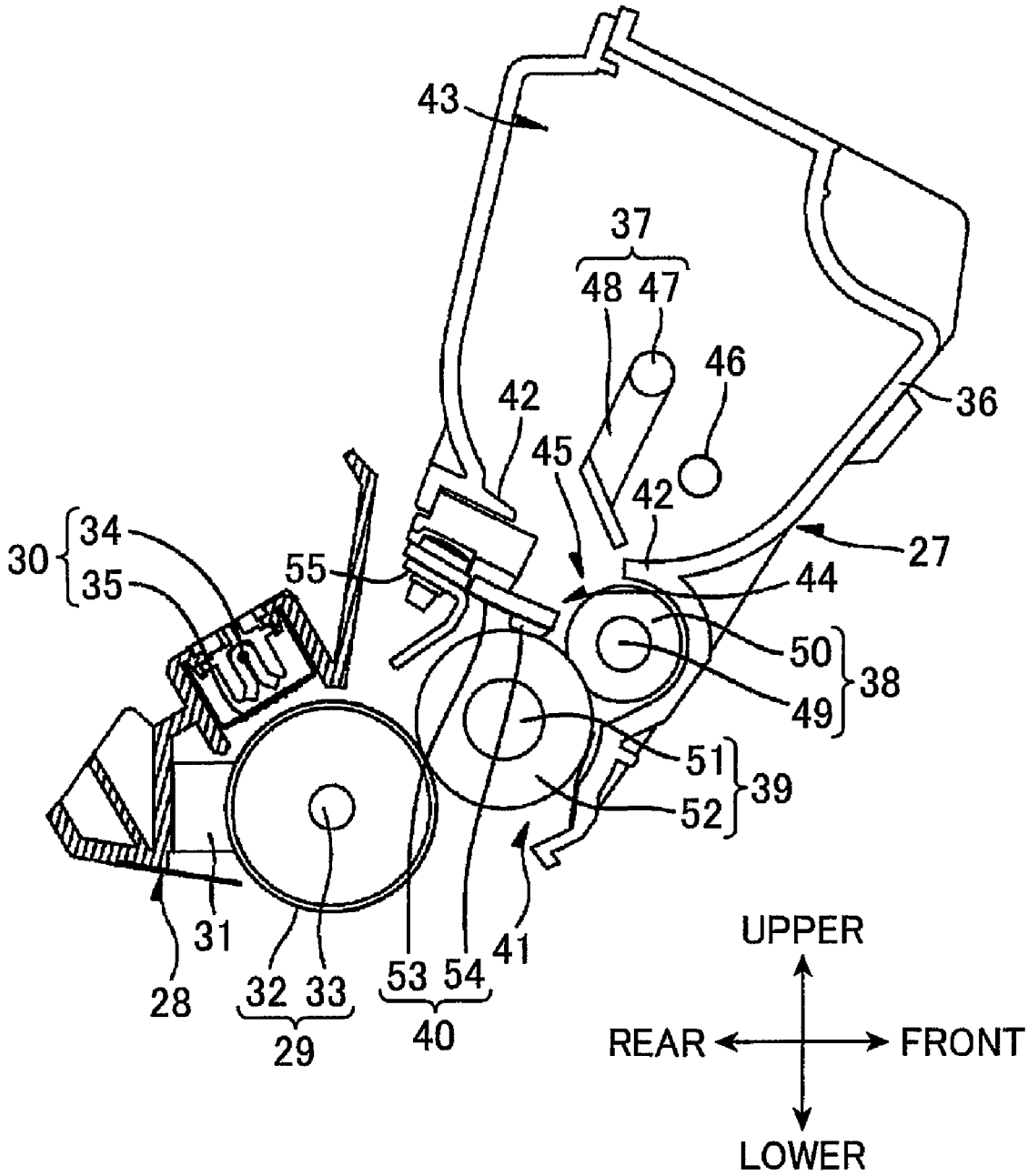
FIG. 2 is a vertical cross-sectional view of a developer cartridge and a drum subunit shown in FIG. 1.

The drum subunits 28 are juxtaposed and spaced at intervals in the front-to-rear direction. In order from front to rear, the drum subunits 28 include a black drum subunit 28K, a yellow drum subunit 28Y, a magenta drum subunit 28M, and a cyan drum subunit 28C. FIG. 2 is a side cross-sectional view of the developer cartridge 27 and drum subunit 28.

As shown in FIG. 2, each drum subunit 28 includes the photosensitive drum 29, a Scorotron charger 30, and a cleaning brush 31.

The photosensitive drum 29 extends in the left-to-right direction and includes a drum main body 32 and a drum shaft 33. The drum main body 32 is cylindrical in shape. The drum shaft 33 extends along the axial direction of the drum main body 32 and freely rotatably supports the drum main body 32. Both ends of the drum shaft 33 in its axial direction are supported on a pair of side plates 103 described later so as not to be able to rotate. During printing operations, the photosensitive drum 29 is driven to rotate by a motor (not shown) disposed within the main casing 2. At this time, all of the four photosensitive drums 29 operate in the same manner. In other words, the four photosensitive drums 29 are driven to rotate at the same speed during rotation operations, while the four photosensitive drums 29 are stopped during non-rotation operations.

The charger 30 is disposed diagonally above and rearward of the photosensitive drum 29. The charger 30 confronts the photosensitive drum 29 but is spaced away from the photosensitive drum 29. The charger 30 includes a discharge wire 34 and a grid 35. The discharge wire 34 is disposed in confrontation with the photosensitive drum 29, but is spaced away therefrom. The grid 35 is disposed between the photosensitive drum 29 and the discharge wire 34. During printing operations, a high voltage is applied to each of the discharge wire 34 and the grid 35.

The cleaning brush 31 is disposed on the rear side of the photosensitive drum 29 so as to confront and contact the same. During image formation, a cleaning bias is applied to the cleaning brush 31.

(3-2-2) Developer Cartridge

As shown in FIG. 1, the developer cartridges 27 are disposed in confrontation with the drum subunits 28 of each color. Specifically, the black developer cartridge 27K is disposed in confrontation with the black drum subunit 28K, the yellow developer cartridge 27Y in confrontation with the yellow drum subunit 28Y, a magenta developer cartridge 27M in confrontation with the magenta drum subunit 28M, and a cyan developer cartridge 27C in confrontation with the cyan drum subunit 28C.

As shown in FIG. 2, the developer cartridge 27 includes a case 36, within which are provided an agitator 37, a supply roller 38, a developing roller 39, and a thickness-regulating blade 40.

The case 36 is box-shaped with an opening 41 formed in the bottom end thereof. A partition wall 42 divides the interior of the case 36 into a toner-accommodating chamber 43 in the upper region of the case 36, and a developing chamber 44 in the lower region of the case 36. An opening 45 is formed in the partition wall 42 to allow communication between the toner-accommodating chamber 43 and developing chamber 44.

The toner-accommodating chamber 43 accommodates toner in a color corresponding to the color of the developer cartridge 27. The toner is a positive-charging, nonmagnetic, single-component polymer toner combined with a coloring agent for each of the colors yellow, magenta, cyan, and black. Windows 46 are formed in both left and right side walls of the case 36 for detecting the amount of toner remaining in the toner-accommodating chamber 43.

The agitator 37 is disposed inside the toner-accommodating chamber 43. The agitator 37 includes an agitator rotational shaft 47 and an agitating member 48. The agitator rotational shaft 47 is rotatably supported on side walls of the casing 36. The agitating member 48 is provided in the axial direction of the agitator rotational shaft 47 and extends outward from the agitator rotational shaft 47 in the radial direction. During the printing operations, a driving force is transmitted to the agitator rotational shaft 47 from a motor (not shown) provided in the main casing 2. As a result, the agitating member 48 moves circuitously in the toner-accommodating chamber 43.

The supply roller 38 is disposed inside the developing chamber 44 and below the opening 45. The supply roller 38 includes a metal roller shaft 49 covered by a sponge roller 50 formed of an electrically conductive sponge material. The metal roller shaft 49 is rotatably supported on the side walls of the casing 36. During printing operations, a driving force is applied from the motor (not shown), thereby rotating the supply roller 38.

The developing roller 39 is disposed in the developing chamber 44 diagonally below and rearward of the supply roller 38. The developing roller 39 includes a metal developing roller shaft 51 rotatably supported in the side walls of the case 36, and a rubber roller 52 formed of an electrically conductive rubber for covering the developing roller shaft 51. A portion of the peripheral surface on the rubber roller 52 is exposed below the developing chamber 44 through the opening 41. The rubber roller 52 contacts the sponge roller 50 of the supply roller 38 with pressure. During image formation, the motor (not shown) disposed in the main casing 2 generates a drive force that is transmitted to the developing roller 39 for rotating the same. A developing bias is also applied to the developing roller 39.

The thickness regulating blade 40 is disposed inside the developing chamber 44 and contacts the developing roller 39 with pressure from the above. The thickness regulating blade 40 includes a blade 53 made of a metal leaf spring and a pressing portion 54 provided on a free end of the blade 53. The pressing portion 54 is formed of an electrically-insulating silicon rubber in a semi-circular shape in cross-section.

A base end of the blade 53 is fixed to the partitioning wall 42 by a fixing member 55. A resilient force of the blade 53 presses the pressing portion 54 on its free end against the rubber roller 52 of the developing roller 39 from the above.

(3-2-3) Developing Operation in Process Unit

In each of the developing cartridges 27, the toner of the corresponding color accommodated in the toner-accommodating chamber 43 moves toward the opening 45, and is discharged to the developing chamber 44 through the opening 45 while being agitated by the agitator 37.

The toner discharged through the opening 45 into the developing chamber 44 is supplied to the supply roller 38, and further to the developing roller 39 by the rotation of the supply roller 38. At this time, the toner is positively tribocharged between the supply roller 38 and the developing roller 39 applied with the developing bias.

The toner supplied to the developing roller 39 is conveyed to a position between the rubber roller 52 of the developing roller 39 and the pressing portion 54 of the thickness regulating blade 40 by the rotation of the developing roller 39, and is borne in a thin layer with a certain thickness on the surface of the rubber roller 52.

As the photosensitive drum 29 corresponding to each developer cartridge 27 rotates, the respective charger 30 charges the surface of the photosensitive drum 29 with a uniform positive polarity. The scanning unit 20 subsequently irradiates a laser beam onto the surface of the positively charged photosensitive drum 29, as shown in FIG. 1, forming an electrostatic latent image on the photosensitive drum 29 corresponding to an image to be formed on the paper 3.

As the photosensitive drum 29 continues to rotate, bringing the electrostatic latent image on the surface of the photosensitive drum 29 against the developing roller 39, the positively charged toner borne on the surface of the developing roller 39 is attracted to the electrostatic latent image (i.e., regions on the surface of the positively charged photosensitive drum 29 exposed to the laser beam and, therefore, having a lower potential). In this way, the latent image is developed into a visible image through reverse development, so that a toner image in the corresponding color is borne on the surface of the photosensitive drum 29.

(3-3) Transfer Unit

The transfer unit 22 is disposed in the main casing 2 above the feeding unit 4 and below the process unit 21. The transfer unit 22 includes a drive roller 56, a follow roller 57, the conveying belt 58, and four transfer rollers 59.

The drive roller 56 and the follow roller 57 are disposed so as to be spaced away from each other in the front-to-rear direction. The conveying belt 58 is an endless belt and is looped around the drive roller 56 and the follow roller 57.

During the printing operation, the drive roller 56 is driven to rotate by a driving force transmitted from a motor (not shown) disposed inside the main casing 2. When the drive roller 56 rotates, the conveying belt 58 moves circuitously between the drive roller 56 and the follow roller 57, such that the convey belt 58 moves in the same direction as the photosensitive drums 29 at transfer positions where the convey belt 58 contacts the photosensitive drums 29. Also, the follow roller 57 rotates in association with the movement of the convey belt 58.

Each transfer roller 59 is disposed inside the conveying belt 58 in confrontation with the corresponding photosensitive drum 29 with the conveying belt 58 interposed therebetween. The transfer rollers 59 followingly rotate such that the transfer rollers 59 move in the same direction as the conveying belt 58 at the transfer positions where the transfer rollers 59 contacts the conveying belt 58. During the printing operations, a transfer bias is applied to each transfer roller 59.

A sheet of paper 3 fed from the feeding unit 4 is conveyed by the conveying belt 58 so as to sequentially pass the transfer positions of the respective photosensitive drums 29 from the front side toward the rear side. During the conveyance, toner images borne on the photosensitive drums 29 are sequentially transferred onto the sheet of paper 3, thereby forming a color image on the paper 3.

The developing roller 39 recovers residual toner remaining on the photosensitive drum 29 after a transfer operation. The cleaning brush 31 functions to remove paper dust deposited on the photosensitive drum 29 by the paper 3 during a transfer operation.

(3-4) Fixing Unit

The fixing unit 23 is disposed in the main casing 2 rearward of the transfer unit 22. The fixing unit 23 includes a heating roller 65, and a pressure roller 66 that applies pressure to the heating roller 65.

The fixing unit 23 fixes the transferred color image to the paper 3 by heat and pressure as the paper 3 passes between the heating roller 65 and the pressure roller 66.

(4) Discharge Unit

The discharge unit 6 includes a substantially C-shaped discharge path 67 leading from the fixing unit 23 to the top of the main casing 2; and a conveying roller 69, a pinch roller 70, and a pair of discharge rollers 71 disposed along the discharge path 67. When a sheet of paper 3 is conveyed from the fixing unit 23, the conveying roller 69 and pinch roller 70 convey the sheet along the discharge path 67, and the discharge rollers 71 receive and discharge the paper 3 onto a discharge tray 68 formed on the top surface of the main casing 2.

2. Drum Unit

Figure 3:
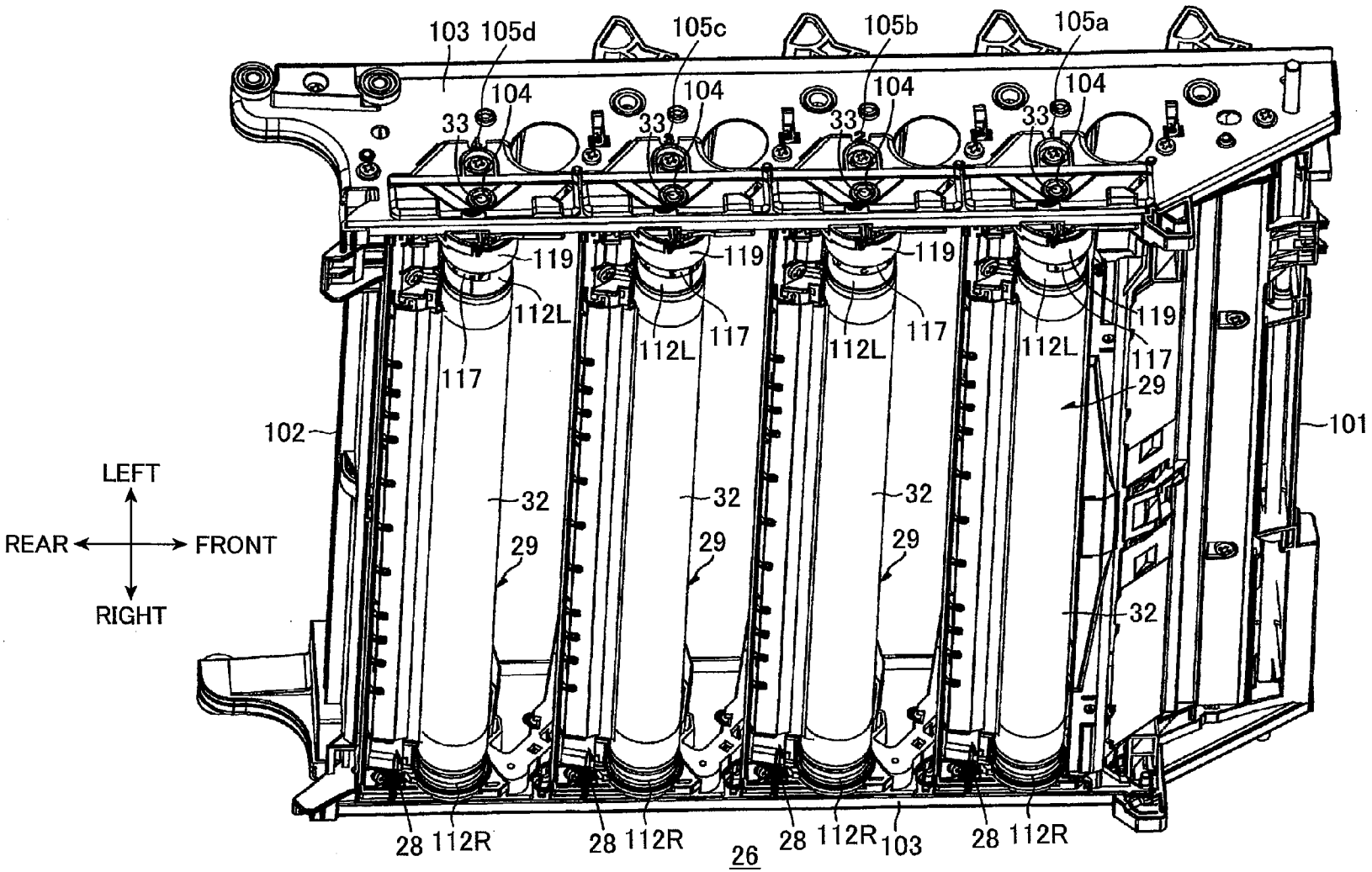
FIG. 3 is a perspective view of a drum unit shown in FIG. 1 as viewed from the left lower side.

FIG. 3 is a perspective view of the drum unit 26 from the left lower side. The drum unit 26 includes the four drum subunits 28 juxtaposed in the front-to-rear direction; a front beam 101 arranged on the front side of the drum subunits 28; a rear beam 102 arranged on the rear side of the drum subunits 28; and a pair of side plates 103 arranged on the left and right sides of the four drum subunits 28, the front beam 101, and the rear beam 102.

Each of the side plates 103 is formed of a material having a greater stiffness than the resin material used to form the drum subunits 28, the front beam 101, and the rear beam 102, such as a metal or a fiber-reinforced resin, and preferably a steel sheet. The side plate 103 has a narrow rectangular plate-shape extending in the front-to-rear direction. The front end of the side plate 103 is fixed to the front beam 101, while the rear end is fixed to the rear beam 102. The two side plates 103 are provided on the left and right sides of the four drum subunits 28 for holding the same.

Shaft holes 104 are formed in each side plate 103 near the lower edge thereof. The widthwise ends of the drum shaft 33 in the photosensitive drum 29 provided in each drum subunit 28 are inserted into the respective shaft holes 104. The shaft holes 104 are spaced at fixed intervals so that the distance between the centers of neighboring shaft holes 104 is the same. The drum shafts 33 are rotatably supported in the side plates 103 with the widthwise ends of the drum shafts 33 inserted into the respective shaft holes 104 formed in the side plates 103.

Marks 105*a*-105*d* (appearing as "1", "2", "3", and "4", respectively) assigned to each of the photosensitive drums 29 are provided on the left side plate 103 in order from the front side at positions for mounting the corresponding photosensitive drums 29. Specifically, the mark 105*a* (mark "1") associated with the black photosensitive drum 29 is provided at a position on the left side plate 103 corresponding to the black photosensitive drum 29. The mark 105*b* (mark "2") associated with the yellow photosensitive drum 29 is provided in a position on the left side plate 103 corresponding to the yellow photosensitive drum 29. The mark 105*c* (mark "3") associated with the magenta photosensitive drum 29 is provided in a position on the left side plate 103 corresponding to the magenta photosensitive drum 29. The mark 105*d* (mark "4") associated with the cyan photosensitive drum 29 is provided in a position on the left side plate 103 corresponding to the cyan photosensitive drum 29.

3. Photosensitive Drums

Figure 4:
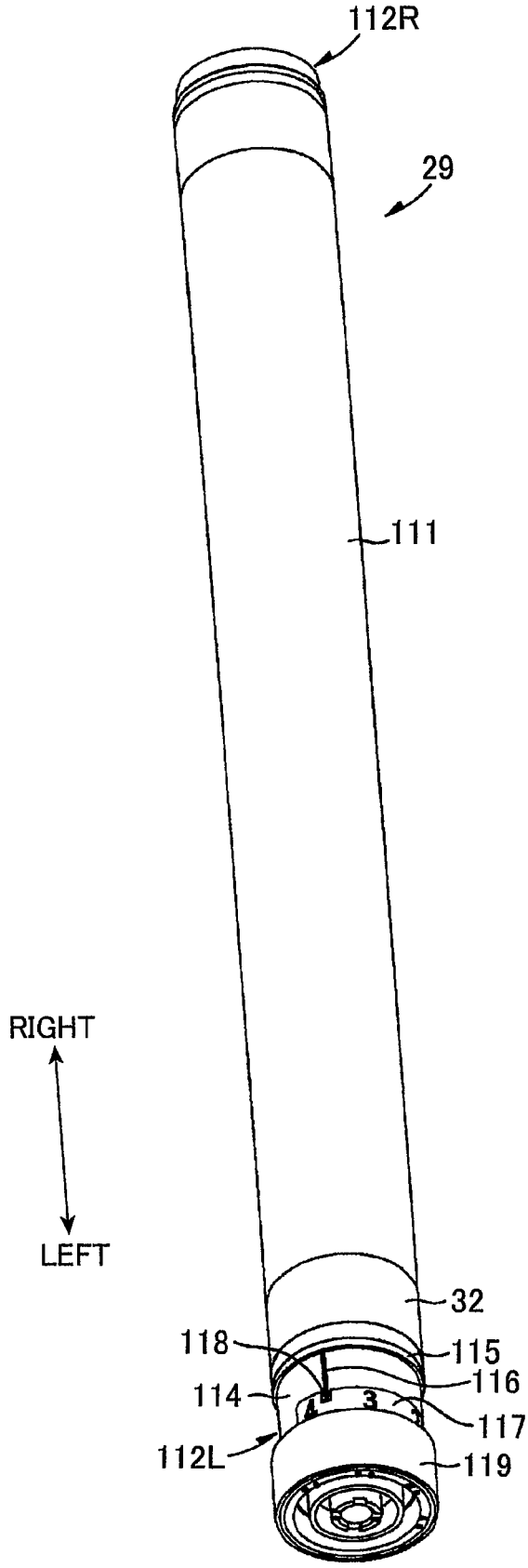
FIG. 4 is a perspective view of a photosensitive drum serving as part of the drum unit shown in FIG. 3.

FIG. 4 is a perspective view of the photosensitive drum 29.

(1) Drum Main Body

The drum main body 32 of the photosensitive drum 29 is formed of aluminum in a cylindrical shape having a thickness of 0.75 mm, for example. A positive-charging photosensitive layer 111 of polycarbonate or the like is formed on the outer peripheral surface of the drum main body 32.

(2) Drum Shaft

The drum shaft 33 (see FIG. 3) is formed of a metal rod having a diameter of 5 mm, for example.

(3) Flange Members

Both axial ends of the drum shaft 33 in each photosensitive drum 29 are rotatably inserted into the centers of left and right flange members 112L and 112R (fixing members) described next.

Figure 5:
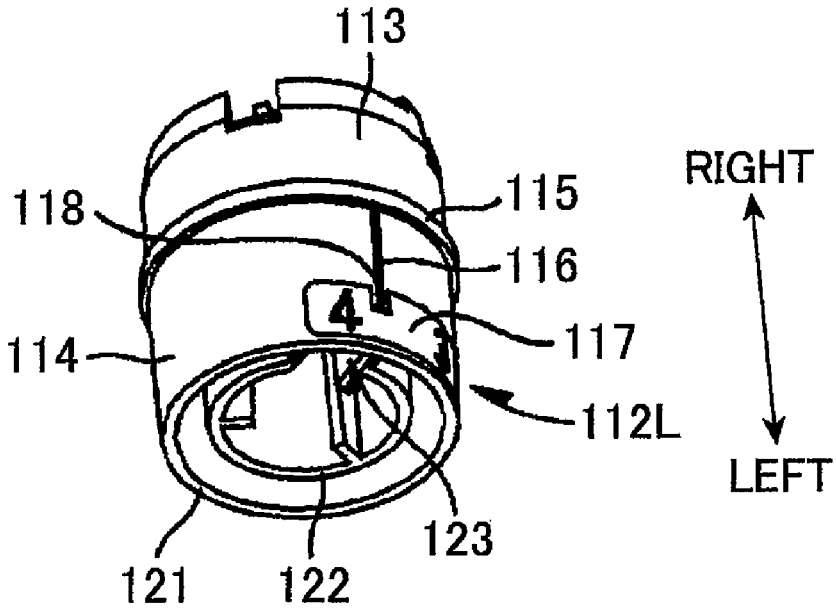
FIG. 5 is a perspective view of a left flange member provided to the photosensitive drum shown in FIG. 4.

FIG. 5 is a perspective view of the left flange member 112L. The flange members 112L and 112R are mounted on both axial ends of the drum main body 32 so as to be incapable of rotating relative to the drum main body 32. The left flange members 112L for all photosensitive drums 29 are molded of an insulating resin material using a single injection mold (the same injection mold), while the right flange members 112R for the photosensitive drums 29 may be molded of an insulating resin material using a plurality of injection molds. Note that the right flange members 112R for all photosensitive drums 29 are molded using a single injection mold.

When the centers of the flange members 112L and 112R deviate from the center of the respective drum main body 32, the outer surface of the drum main body 32 has eccentricity relative to the centers of the flange members 112L and 112R (the drum shaft 33) when the flange members 112L and 112R are fixed to (mounted on) the drum main body 32. Since a single injection mold (the same injection mold) is used to form the left flange members 112L provided on the photosensitive drums 29, the eccentricity of the drum main body 32 on each photosensitive drum 29 is the same when the left flange members 112L are fixed to the respective main drum bodies 32. FIG. 5 only shows the left flange member 112L. Each of the left flange members 112L is integrally provided with an insertion part 113 that is inserted into the drum main body 32, an exposed part 114 exposed on the outside of the drum main body 32, and a connecting part 115 for connecting the insertion part 113 to the exposed part 114.

The insertion part 113 is cylindrical in shape with an outer diameter substantially the same as the diameter of the inner peripheral surface of the drum main body 32.

The exposed part 114 is formed in a substantially double cylindrical shape having a substantially cylindrical outer cylinder 121, and a substantially cylindrical inner cylinder 122. The outer cylinder 121 has a cylindrical outer surface formed with nearly the same diameter as the outer surface of the insertion part 113. A reference elongated protrusion 116 is formed on the outer peripheral surface of the outer cylinder 121, extending in the axial direction. A seal 117 is bonded to the outer peripheral surface of the outer cylinder 121.

The seal 117 extends along the circumferential direction of the exposed part 114. The marks "1", "2", "3", and "4" are inscribed at fixed intervals around the seal 117 in a counterclockwise direction when viewed from the left side of the seal 117 while the photosensitive drum 29 is mounted in the drum unit 26. A notch 118 is formed in the seal 117 at a position near the mark "4" as a rectangular shape cut out from the inner edge (right edge). The seal 117 is bonded to the peripheral surface of the outer cylinder 121 in the exposed part 114 so that the reference elongated protrusion 116 is fitted into the notch 118. In this way, the marks "1", "2", "3", and "4" are arranged so as to have the same positional relationship with the eccentric phase of the insertion part 113 in the left flange member 112L, that is, the eccentric phase of the drum main body 32, for all photosensitive drums 29.

A fitting part 123 for fitting about a protrusion 127 described later is formed as a cutout in the inner cylinder 122 of the exposed part 114.

The connecting part 115 has a larger outer diameter than the outer diameters of the insertion part 113 and exposed part 114. Hence, the connecting part 115 cannot be inserted into the drum main body 32, but serves as a stopper when the insertion part 113 is inserted into the drum main body 32.

(4) Drum Gear

As shown in FIG. 4, a drum gear 119 (gear part) is joined with the outer axial end of the left flange member 112L.

Figure 6:
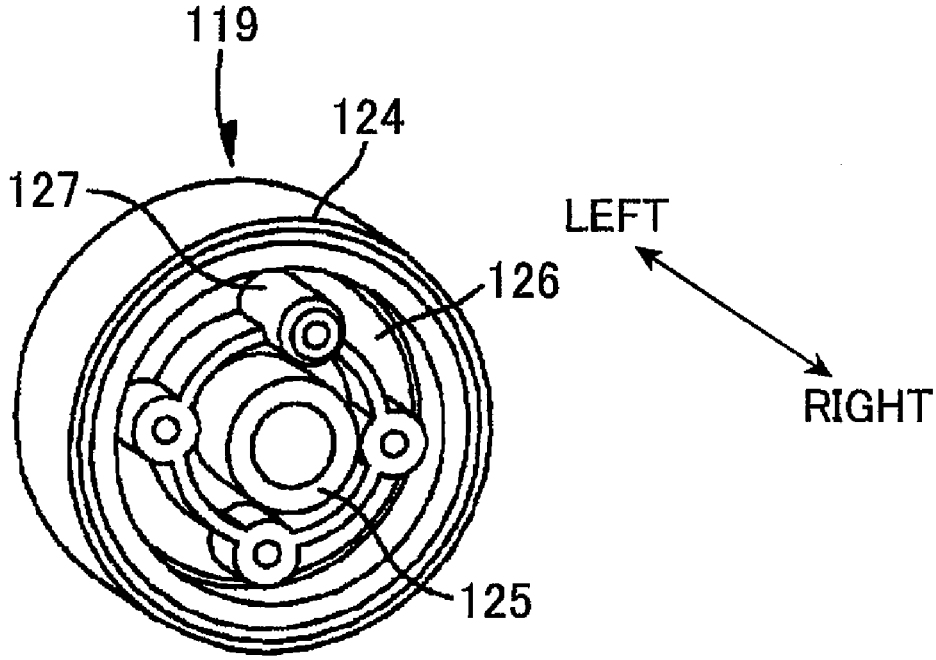
FIG. 6 is a right side perspective view of a drum gear provided to the photosensitive drum shown in FIG. 4.

FIG. 6 is a perspective view of the drum gear 119 from the right side (the left flange member 112L side). The drum gears 119 of all photosensitive drums 29 are molded of an insulating resin material using the same injection mold. Each drum gear 119 is integrally configured of a cylindrical gear forming part 124 having a plurality of gear teeth (not shown) formed around the outer peripheral surface thereof, a cylindrical shaft insertion part 125 in which the drum shaft 33 (see FIG. 3) is inserted, a connecting part 126 for connecting the gear forming part 124 and shaft insertion part 125, and the protrusion 127 protruding rightward from the connecting part 126.

The protrusion 127 protrudes farther rightward than the right edge of the gear forming part 124. When the drum gear 119 is joined to the left flange member 112L, the protrusion 127 is fitted into the fitting part 123 of the left flange member 112L (see FIG. 5), thereby positioning the drum gear 119 in a predetermined rotational position relative to the left flange member 112L. Since the drum gears 119 for all photosensitive drums 29 have been molded with the same injection mold, the positional relationship of the left flange member 112L and drum gear 119 in the rotational direction is the same for all photosensitive drums 29.

A motor (not shown) is provided in the main casing 2 for inputting a drive force to the drum gears 119. The drive force causes the drum gears 119 to rotate around the drum shafts 33, and the left flange members 112L, the main drum bodies 32, and the right flange members 112R rotate together with the respective drum gears 119.

Since the drum gears 119 of all photosensitive drums 29 have been molded with the same injection mold, a gear mesh error between the drum gear 119 and the gear on the main body side engaged with the drum gear 119 (a gear provided in the main casing 2) is the same for all photosensitive drums 29. The drum gears 119 of all photosensitive drums 29 also have the same eccentricity. Since the left flange member 112L and drum gear 119 have the same positional relationship in the rotating direction for all photosensitive drums 29, the marks "1", "2", "3", and "4" have the same positional relationship for all photosensitive drums 29 in relation to the phase of an irregular rotational speed caused by eccentricity of the drum gear 119 and gear mesh error.

Note that that the positional relationships (phases) between the left flange members 112L and the respective main drum bodies 32 in the circumferential direction may be arbitrary, and that the positional relationships between the right flange members 112R and the respective main drum bodies 32 in the circumferential direction may be arbitrary. In this regard, it is ideal that the positional relationships (phases) between the left and right flange members 112L and 112R and the respective main drum bodies 32 in the circumferential direction are properly adjusted like the left flange members 112L and the drum gears 119. However, processing accuracy of the main drum bodies 32 is higher than that of the flange members 112L and 112R and the drum gears 119, because the main drum bodies 32 is made of metal while the flange members 112L and 112R and the drum gears 119 are made of resin. Thus, the flange members 112L and 112R and the drum gears 119 potentially produce larger errors in positions of toner images (color registration errors). Hence, it is the most important that the positional relationships (phases) between the left flange members 112L and the drum gears 119 in the circumferential direction are properly adjusted.

4. Arrangement of the Photosensitive Drums

Figure 7:
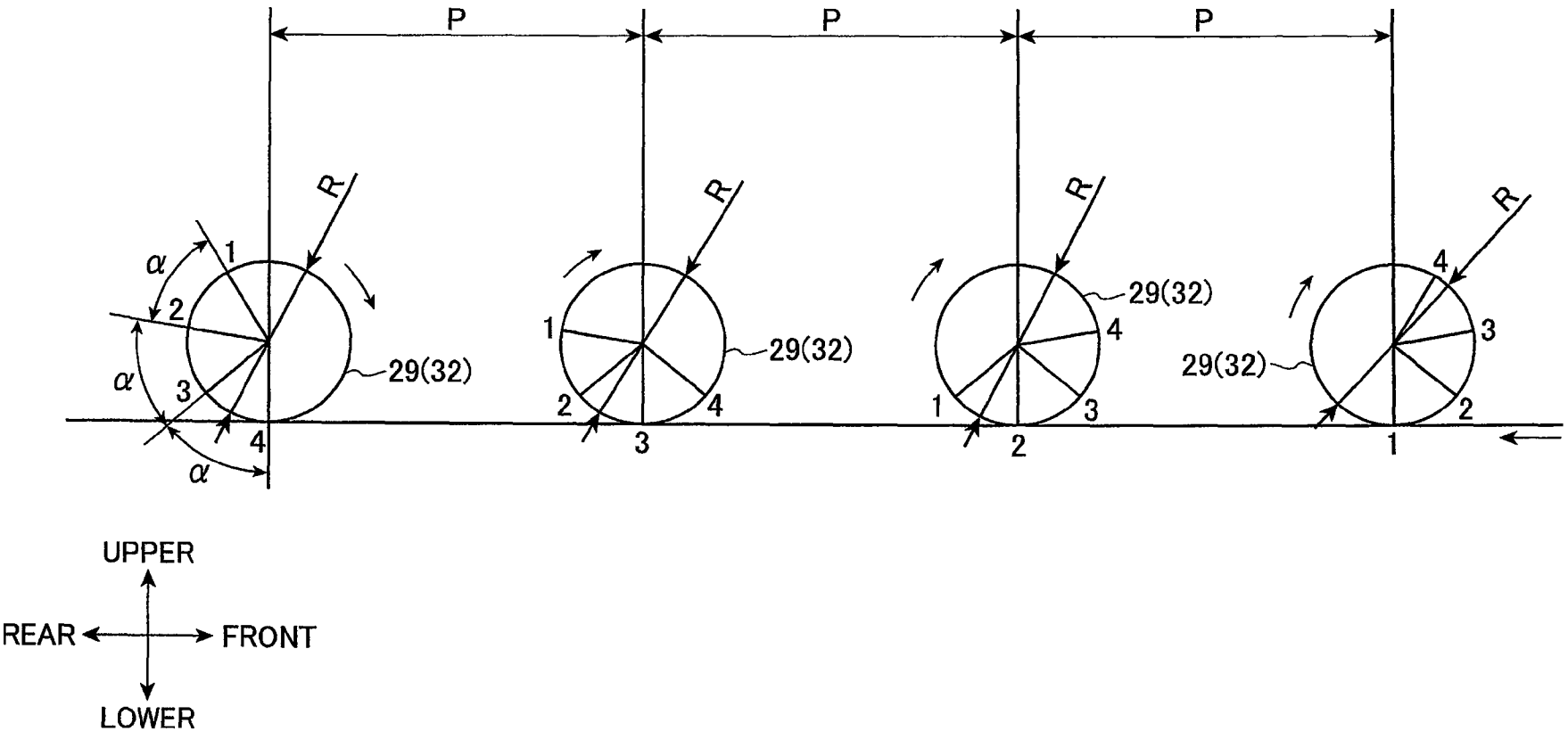
FIG. 7 is an explanatory diagram illustrating arrangement of the photosensitive drums shown in FIG. 3.

FIG. 7 is an explanatory diagram illustrating the arrangement of the photosensitive drums 29.

By arranging the for photosensitive drums 29 between the side plates 103 of the drum unit 26 so that the distance between any two neighboring drum shafts 33 is equal, a distance P between the center points (center axes) of any two neighboring photosensitive drums 29 (main drum bodies 32) is identical, as shown in FIG. 7.

The marks "1", "2", "3", and "4" are inscribed on the seal 117 (see FIG. 4) at positions such that an angle $\alpha$ is formed by drawing lines from the center of the photosensitive drum 29 (drum main body 32) to any two neighboring marks, where $\alpha$ is expressed by the following equation (1).

$$\alpha=\{(S-P)/S\}\times 360° \quad (1)$$

Here, S is the outer circumferential length of the drum main body 32. It is assumed that P is not equal to S. As shown in FIGS. 3 and 7, if the mark "1" is used as a reference, the mark "2" is inscribed at a position forming a central angle $\alpha$ counterclockwise from the mark "1" when viewed from the drum gear 119 side, the mark "3" is inscribed at a position forming a central angle $2\alpha$ counterclockwise from the mark "1" when viewed from the drum gear 119 side, and the mark "4" is inscribed at a position forming a central angle $3\alpha$ counterclockwise from the mark "1" when viewed from the drum gear 119 side.

For example, if the distance P between center points of neighboring photosensitive drums 29 is 65 mm and the outer peripheral surface of each drum main body 32 has a diameter R of 24 mm, then the outer circumferential length S of the drum main body 32 is approximately 75.4 mm and the angle $\alpha$ is approximately 49.7°. Hence, the marks "1", "2", "3", and "4" are inscribed sequentially around the outer peripheral surface of the left flange member 112L at fixed angles of 49.7°.

Next, the rotated positions of the four photosensitive drums 29 are adjusted so that the mark on the photosensitive drum 29 matching the mark displayed on the side plate 103 for the corresponding photosensitive drum 29 faces downward. Note that this adjustment can be performed by an operator of manufacture of the color laser printer 1, and can also be performed by a user after the user has changed the position or orientation of the photosensitive drums 29.

More specifically, since the mark "1" is inscribed on the side plate 103 at a position corresponding to the black photosensitive drum 29, the black photosensitive drum 29 is rotated until the mark "1" inscribed on the respective seal 117 faces downward. Since the mark "2" is inscribed on the side plate 103 at a position corresponding to the yellow photosensitive drum 29, the yellow photosensitive drum 29 is rotated until the mark "2" inscribed on the respective seal 117 faces downward. Since the mark "3" is inscribed on the side plate 103 at a position corresponding to the magenta photosensitive drum 29, the magenta photosensitive drum 29 is rotated until the mark "3" inscribed on the respective seal 117 faces downward. Since the mark "4" is inscribed on the side plate 103 at a position corresponding to the cyan photosensitive drum 29, the cyan photosensitive drum 29 is rotated until the mark "4" inscribed on the respective seal 117 faces downward.

As indicated in equation (1) above, the angle $\alpha$ corresponds to the difference between the outer circumferential length S of the drum main body 32 and the distance P between centers of neighboring photosensitive drums 29. Hence, by adjusting the rotational position of the four photosensitive drums 29 as described above, it is possible to align the positions of the color images transferred from each photosensitive drum 29 onto the paper 3.

Figure 8A:
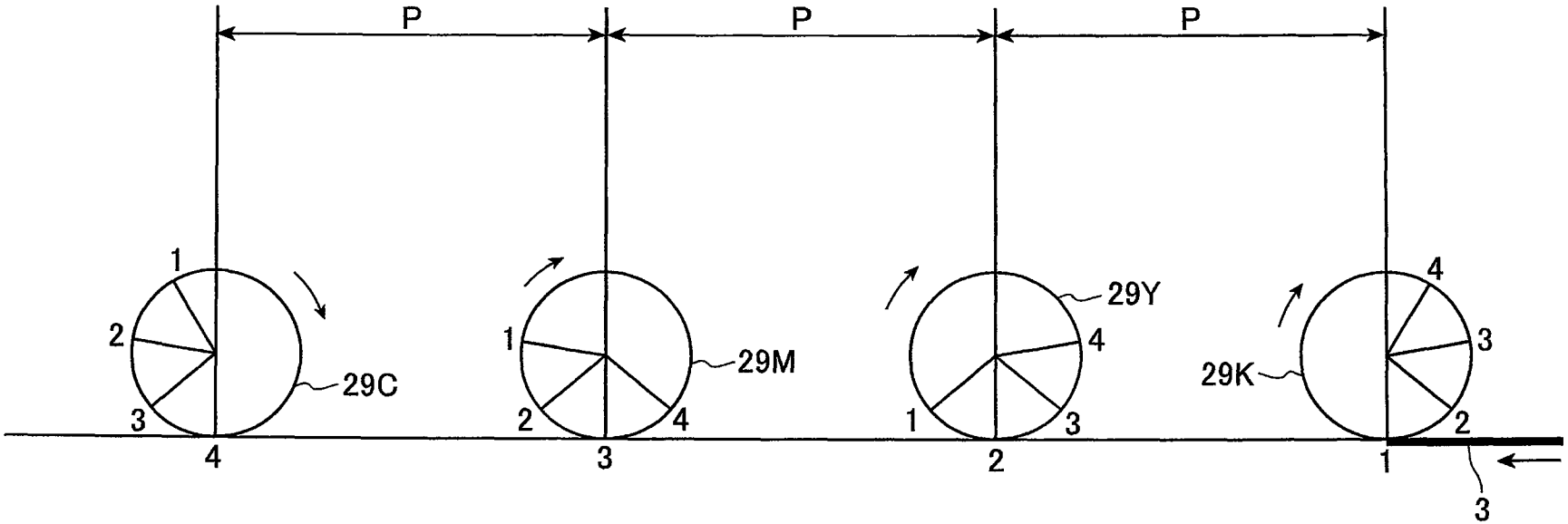
FIG. 8A is an explanatory diagram illustrating operations of the photosensitive drums, wherein a leading edge of paper is located at a position directly below a black photosensitive drum when a mark "1" on the black photosensitive drum faces downward.

More specifically, as shown in FIG. 8A, it is assumed that a leading edge (reference part in this example) of the paper 3 arrives at a position directly below a black photosensitive drum 29K when the mark "1" on the black photosensitive drum 29K is facing downward. Note that the leading edge of the paper 3 need not be the reference part, and any other part on the paper 3 may be the reference part. In this state, the black toner image is transferred from the black photosensitive drum 29K to the paper 3.

Figure 8B:
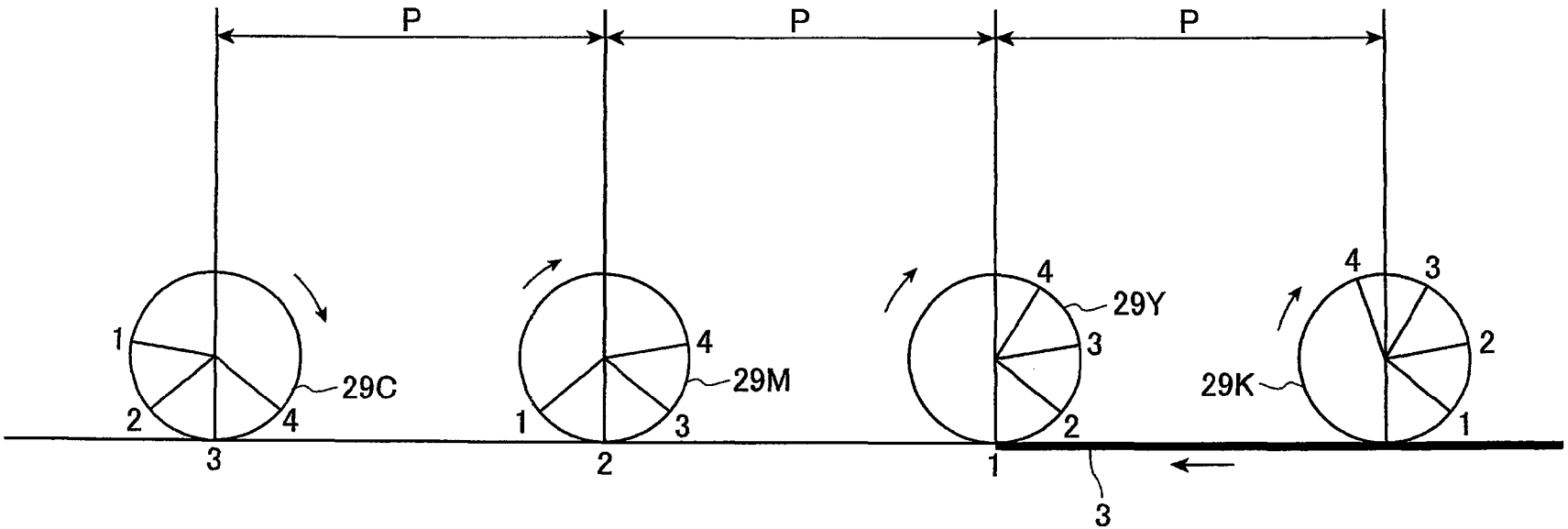
FIG. 8B is an explanatory diagram illustrating operations of the photosensitive drums, wherein the leading edge of paper is located at a position directly below a yellow photosensitive drum when a mark "1" on the yellow photosensitive drum faces downward.

When the paper 3 is conveyed by the distance P from the position shown in FIG. 8A, as shown in FIG. 8B, the leading edge of the paper 3 arrives at a position directly below a yellow photosensitive drum 29Y. During this period, each photosensitive drum 29K-29C rotates by an angle of $(P/S)\times 360°$ which corresponds to a circumferential length P in the clockwise direction in FIG. 8B.

As described above, the angle $\alpha$ between the neighboring marks "1", "2", "3", and "4" is shown as $\alpha=\{(S-P)/S\}\times 360°$. Hence, the angle of $(P/S)\times 360°$ which corresponds to the circumferential length P equals to an angle of $360°\alpha$. Accordingly, although the mark "2" on the yellow photosensitive drum 29Y faces downward in FIG. 8A, the mark "1" on the yellow photosensitive drum 29Y faces downward in FIG. 8B. In this state, the yellow toner image is transferred from the yellow photosensitive drum 29Y and is superimposed over the black toner image.

Figure 8C:
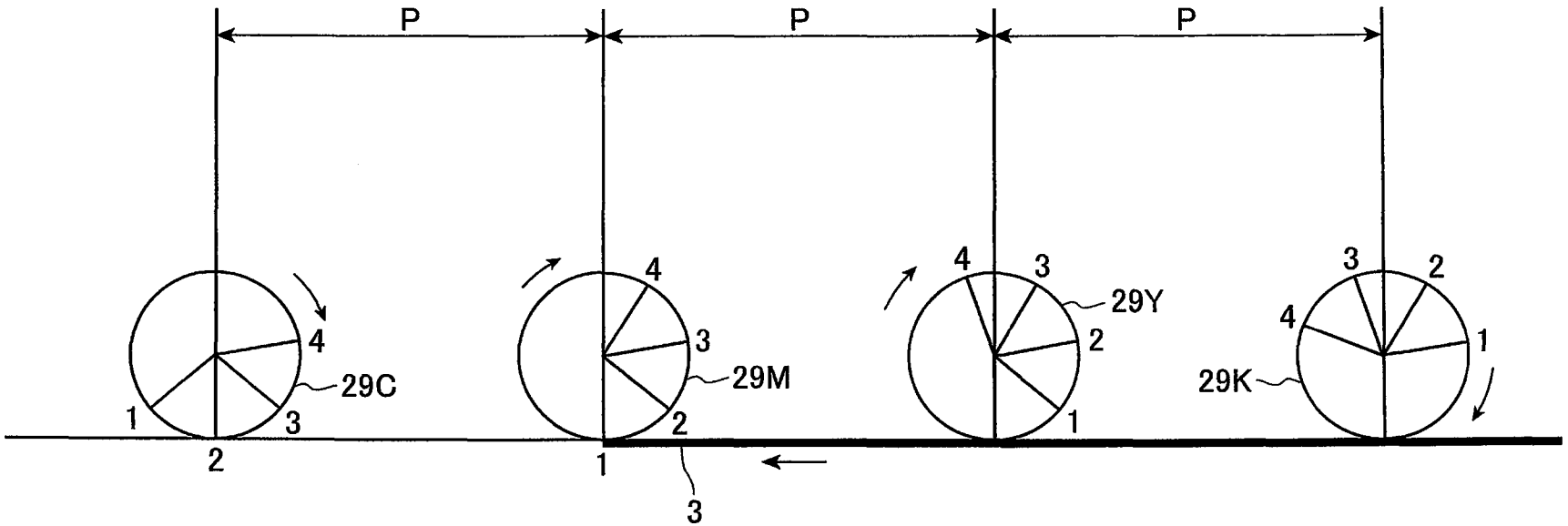
FIG. 8C is an explanatory diagram illustrating operations of the photosensitive drums, wherein the leading edge of paper is located at a position directly below a magenta photosensitive drum when a mark "1" on the magenta photosensitive drum faces downward.

Similarly, when the paper 3 is conveyed by the distance P to the position shown in FIG. 8C, the leading edge of the paper 3 arrives at a position directly below a magenta photosensitive drum 29M at which time the mark "1" on the magenta photosensitive drum 29M faces downward. In this state, the magenta toner image is transferred from the magenta photosensitive drum 29M and is superimposed over black and yellow toner images.

Figure 8D:
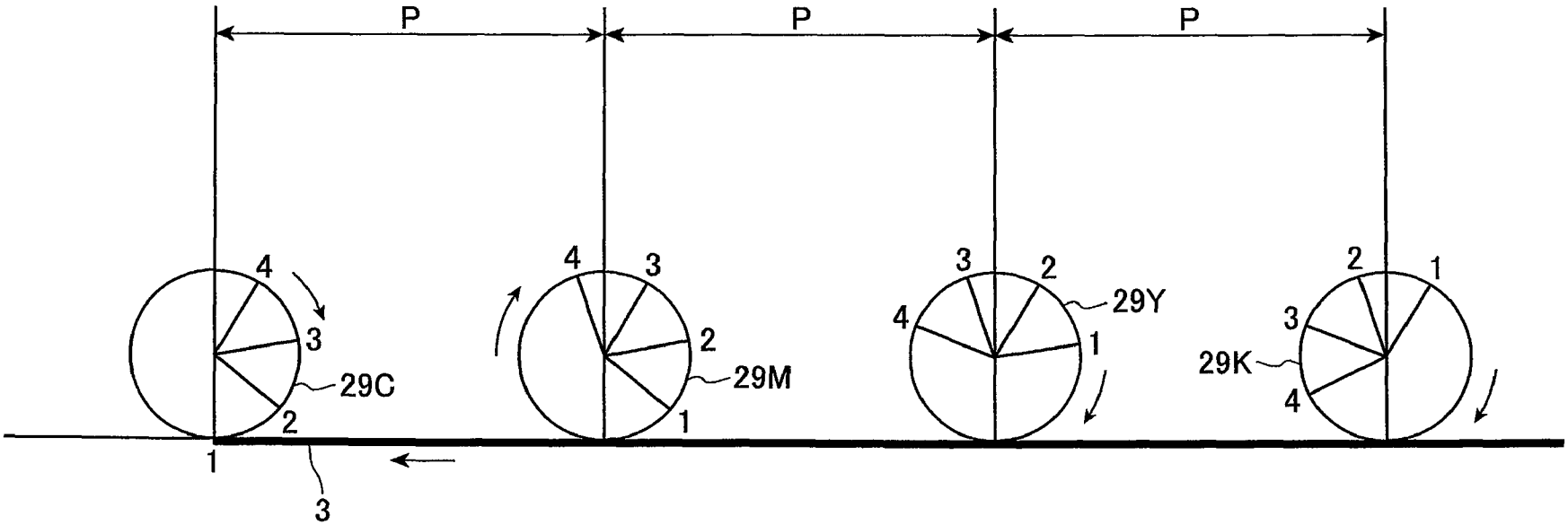
FIG. 8D is an explanatory diagram illustrating operations of the photosensitive drums, wherein the leading edge of paper is located at a position directly below a cyan photosensitive drum when a mark "1" on the cyan photosensitive drum faces downward.

Further, when the paper 3 is conveyed by the distance P to the position shown in FIG. 8D, the leading edge of the paper 3 arrives at a position directly below a cyan photosensitive drum 29C at which time the mark "1" on the cyan photosensitive drum 29C faces downward. At this position, the cyan toner image is transferred from the cyan photosensitive drum 29C and is superimposed over the other three color toner images.

As described above, the marks "1", "2", "3", and "4" have the same positional relationship to the eccentric phase of the respective drum main body 32 for all photosensitive drums 29. Accordingly, images transferred onto the paper 3 from the photosensitive drums 29 when the same mark of the photosensitive drums 29 is facing downward are transferred to the same position on the paper 3. Further, since the marks "1", "2", "3", and "4" have the same positional relationship to the phase of rotational speed irregularities in the drum gear 119 for all photosensitive drums 29, color registration problems do not occur due to such irregular rotational speeds. Therefore, the image forming apparatus of the embodiment can produce high-quality color images with no color registration error.

5. Operations and Effects

As described above, the four photosensitive drums 29 are arranged at equal intervals so that the distance between the centers of any pair of adjacent photosensitive drums 29 is a constant distance P. Marks "1", "2", "3", and "4" are inscribed in each of the photosensitive drums 29 at positions including a common reference position in the peripheral direction (a position adjacent to the reference elongated protrusion 116 on the upstream side with respect to the rotational direction of the photosensitive drum 29), and three positions offset successively from the reference position by a central angle in the peripheral direction of $\{(S-P)/S\}\times 360°$. By adjusting the relative rotational positions among the photosensitive drums 29 based on the marks "1", "2", "3", and "4" inscribed therein, the eccentric phase of the photosensitive drums 29 can be aligned with the image.

Further, the drum gears 119 that rotate integrally with the respective left flange members 112L are molded using the same injection mold and are formed in the same shape and have the same eccentricity. Further, the gear mesh error between each of the drum gears 119 and the corresponding gears meshed with the drum gears 119 is uniform. As a result, the rotational speed irregularity in the drum gear 119 produced by the eccentricity of the drum gear 119 and the gear mesh error can be made uniform for all drum gears 119. The rotational speed irregularities generated in all photosensitive drums 29 can be made uniform by fitting the protrusions 127 of the drum gears 119 in the respective fitting parts 123 of the left flange members 112L so that the drum gears 119 are positioned in predetermined rotated positions relative to the left flange members 112L. Accordingly, by adjusting the relative rotated positions of the photosensitive drums 29 based on the marks "1", "2", "3", and "4" inscribed in the photosensitive drums 29, the phase of the rotational speed irregularities produced in the photosensitive drums 29 can be aligned relative to the image, thereby producing high-quality images with no color registration error.

In the color laser printer 1 of the embodiment, marks are inscribed on the side plate 103 of the drum unit 26 at positions corresponding to each of the photosensitive drums 29 to indicate the mark on the respective photosensitive drums 29 that should be facing downward. Hence, an operator can easily and reliably align the eccentric phase of the photosensitive drums 29 relative to the image by checking the marks inscribed in the side plate 103 and rotating each of the photosensitive drums 29 so that the same mark as the corresponding mark on the side plate 103 is facing downward. Hence, with the color laser printer 1 according to the embodiment, the eccentric phases of the photosensitive drums 29 can be aligned relative to the image through a simple and inexpensive construction that does not require sensors or the like for detecting the phases of the photosensitive drums 29. Hence, the color laser printer 1 of the embodiment can transfer toner images in each color to the paper 3 with proper registration, thereby producing high-quality color images with no color registration error.

Further, inscribing the marks "1", "2", "3", and "4" on the left flange members 112L of the photosensitive drums 29 enhances the visibility of the marks.

While the invention has been described in detail with reference to the above aspects thereof, it would be apparent to those skilled in the art that various changes and modifications may be made therein without departing from the scope of the claims.

In the above-described embodiment, the seal 117 in which the marks "1", "2", "3", and "4" are inscribed, is bonded to the left flange member 112L. However, these marks may be inscribed in the outer peripheral surface of the left flange member 112L itself through laser engraving.

The marks "1", "2", "3", and "4" may be inscribed in the outer peripheral surface of the drum main body 32. Further, since the left flange member 112L and drum gear 119 rotate integrally with each other, the marks "1", "2", "3", and "4" may also be inscribed in the endface of the drum gear 119.

Further, the marks provided to the photosensitive drums 29 and the side plate 103 are not limited to numerals such as "1", "2", "3", and "4". Alphabets such as "A", "B", "C", and "D" or other characters or symbols may be used.

While the flange members 112L and 112R and drum gear 119 are formed as separate components in the above-described embodiment, the flange members 112L and 112R and drum gear 119 may be formed integrally. In this case, the integrally formed flange members 112L and 112R and drum gear 119 are preferably molded using the same injection mold for all photosensitive drums 29.

In the above-described embodiment, the image forming apparatus of the invention is applied to a direct transfer-type color laser printer for directly transferring toner images from the photosensitive drums 29 to the paper 3. However, the image forming apparatus may be an intermediate transfer-type color laser printer for temporarily transferring color toner images from the photosensitive drums to an intermediate transfer member, and subsequently transferring the composite toner image onto the paper.

What is claimed is:

1. A photosensitive drum unit comprising:

a frame; and a plurality of photosensitive drums supported by the frame and having a shape identical with one another, each of the plurality of photosensitive drums being rotatable about a rotational axis, the plurality of photosensitive drums being arranged such that a distance between rotational axes of adjacent photosensitive drums is a constant distance P, the plurality of drums including a first drum and a second drum, wherein each of the plurality of photosensitive drums has a circumferential reference position that is common to all of the plurality of photosensitive drums, each of the plurality of photosensitive drums having a plurality of marks at circumferential positions that are defined relative to the circumferential reference position, adjacent two positions of the circumferential positions being spaced by a central angle of $\{(S-P)/S\}\times 360°$ where S is a circumferential length of each of the plurality of photosensitive drums, each of the first drum and the second drum including both a first mark and a second mark as the plurality of marks, wherein the first drum is positioned such that the first mark of the first drum is set relative to a given angular position, and wherein the second drum is positioned such that the second mark of the second drum is set relative to the given angular position.

2. The photosensitive drum unit according to claim 1, wherein the plurality of marks on each of the plurality of photosensitive drums includes a specific mark, the specific mark being different among the plurality of photosensitive drums; and wherein the plurality of photosensitive drums is supported by the frame such that the specific mark on each of the plurality of photosensitive drums is oriented toward a same direction.

3. The photosensitive drum unit according to claim 2, wherein the circumferential positions include the circumferential reference position and other positions, a number of the other positions being one less than a number of the plurality of photosensitive drums;

wherein each of the plurality of marks is different from one another; and wherein the frame has frame marks in one-to-one correspondence with the specific mark on each of the plurality of photosensitive drums, the frame marks being provided at positions corresponding to respective arranged positions of the plurality of photosensitive drums.

4. The photosensitive drum unit according to claim 1, wherein each of the plurality of photosensitive drums comprises:

a drum main body having a cylindrical shape and having an axial end; and a fixing member that is fixed to the axial end such that the fixing member is incapable of rotating relative to the drum main body; and wherein the fixing member of each of the plurality of photosensitive drums is molded with a same injection mold.

5. The photosensitive drum unit according to claim 4, wherein each of the drum main body and the fixing member has a circumferential surface; and wherein the plurality of marks is provided to either the circumferential surface of the drum main body or the circumferential surface the fixing member.

6. The photosensitive drum unit according to claim 4, wherein each of the plurality of photosensitive drums further comprises a gear part that is configured to rotate together with the fixing member.

7. The photosensitive drum unit according to claim 6, wherein the gear part is a separate member from the fixing member;

wherein the gear part of each of the plurality of photosensitive drums is molded with another same injection mold;

wherein either one of the fixing member and the gear part has a first engaging part that positions the gear part at a predetermined rotational position relative to the fixing member; and wherein the other one of the fixing member and the gear part has a second engaging part that engages the first engaging part.

8. The photosensitive drum unit according to claim 4, wherein the fixing member is integrally provided with an insertion part that is inserted into the drum main body, an exposed part exposed on outside of the drum main body, and a connecting part that connects the insertion part with the exposed part; and wherein the plurality of marks is provided to an outer circumferential surface of the exposed part.

9. The photosensitive drum unit according to claim 8, wherein the exposed part has an elongated protrusion that is integrally formed on the outer circumferential surface and that extends in an axial direction;

wherein a seal is bonded to the outer circumferential surface, the seal extending in a circumferential direction and having the plurality of marks arranged at fixed intervals along the circumferential direction, the seal being formed with a notch at a predetermined position; and wherein the seal is bonded to the outer circumferential surface such that the elongated protrusion is fitted into the notch.

10. The photosensitive drum unit according to claim 1, wherein the plurality of photosensitive drums further comprises:

a third drum positioned such that a third mark is set relative to the given angular position, and a fourth drum positioned such that a fourth mark is set relative to the given angular position.

11. The photosensitive drum unit according to claim 10, wherein the plurality of photosensitive drums are positioned relative to each other such that, when the first drum is at a given rotation relative to the frame identified by the first mark, the second drum is at a rotation identified by the second mark, the third drum is at a rotation identified by the third mark, and the fourth drum is at a rotation identified by the fourth mark.

12. An image forming apparatus comprising:

an apparatus main body; and a photosensitive drum unit mounted on the apparatus main body, the photosensitive drum unit comprising:

a frame; and a plurality of photosensitive drums supported by the frame and having a shape identical with one another, each of the plurality of photosensitive drums being rotatable about a rotational axis, the plurality of photosensitive drums being arranged such that a distance between rotational axes of adjacent photosensitive drums is a constant distance P, the plurality of drums including a first drum and a second drum, wherein each of the plurality of photosensitive drums has a circumferential reference position that is common to all of the plurality of photosensitive drums, each of the plurality of photosensitive drums having a plurality of marks at circumferential positions that are defined relative to the circumferential reference position, adjacent two positions of the circumferential positions being spaced by a central angle of $\{(S-P)/S\}\times 360°$ where S is a circumferential length of each of the plurality of photosensitive drums, each of the first drum and the second drum including both a first mark and a second mark as the plurality of marks, wherein the first drum is positioned such that a the first mark of the first drum is set relative to a given angular position, and wherein the second drum is positioned such that of the second drum is set relative to the given angular position.

13. The image forming apparatus according to claim 12, wherein the plurality of photosensitive drums further comprises:

a third drum positioned such that a third mark is set relative to the given angular position, and a fourth drum positioned such that a fourth mark is set relative to the given angular position.

14. The image forming apparatus according to claim 13, wherein the plurality of photosensitive drums are positioned relative to each other such that, when the first drum is at a given rotation relative to the frame identified by the first mark, the second drum is at a rotation identified by the second mark, the third drum is at a rotation identified by the third mark, and the fourth drum is at a rotation identified by the fourth mark.

* * * * *